US005218408A

United States Patent [19]

Inada et al.

[11] Patent Number: 5,218,408

[45] Date of Patent: Jun. 8, 1993

[54] IMAGE FORMING APPARATUS WITH PHOTOSENSORS FOR DETECTING ORIGINAL SIZE

[75] Inventors: Akira Inada; Yasushi Handa; Tadasi Renbutsu, all of Gifu, Japan

[73] Assignee: Sanyo Electric Co., Ltd., Osaka, Japan

[21] Appl. No.: 733,002

[22] Filed: Jul. 18, 1991

Related U.S. Application Data

[63] Continuation of Ser. No. 337,667, Apr. 13, 1989, abandoned.

[30] Foreign Application Priority Data

| | | | |
|---|---|---|---|
| Apr. 15, 1988 | [JP] | Japan | 63-94208 |
| Apr. 15, 1988 | [JP] | Japan | 63-94209 |
| Apr. 15, 1988 | [JP] | Japan | 63-94210 |
| Jul. 12, 1988 | [JP] | Japan | 63-173002 |

[51] Int. Cl.[5] ..... G03G 21/00

[52] U.S. Cl. ..... 355/231; 355/75; 355/311

[58] Field of Search ..... 355/230, 231, 311, 75, 355/203, 208

[56] References Cited

U.S. PATENT DOCUMENTS

| | | | |
|---|---|---|---|
| 4,540,269 | 9/1985 | Nishiyama | 355/75 X |

FOREIGN PATENT DOCUMENTS

| | | | |
|---|---|---|---|
| 58-35563 | 3/1983 | Japan . | |
| 0105258 | 6/1983 | Japan | 355/230 |
| 0163966 | 9/1983 | Japan | 355/75 |
| 0187336 | 10/1984 | Japan | 355/75 |
| 0002938 | 1/1985 | Japan | 355/208 |
| 0005245 | 1/1986 | Japan | 355/75 |
| 0023137 | 1/1986 | Japan | 355/75 |
| 61-79108 | 4/1986 | Japan . | |
| 0065030 | 3/1987 | Japan | 355/311 |
| 0265642 | 11/1987 | Japan | 355/75 |

*Primary Examiner*—A. T. Grimley
*Assistant Examiner*—Nestor R. Ramirez
*Attorney, Agent, or Firm*—Darby & Darby

[57] ABSTRACT

An imaging forming apparatus includes a platen on which an original is put, and a platen cover mounted to be opened or closed with respect to the platen. A plurality of reflection type photosensors are embedded in the platen cover at predetermined positions. First, a sensor circuit including photosensors is set in a first mode. When an original is put on the platen and the platen cover is closed, photosensors detect the reflection light from the original such that the CPU can determine a size of the original based upon sensor inputs from the sensor circuit. Thereafter, in order to detect opening or closing of the platen cover, the sensor circuit is set in a second mode. In the second mode, total sensitivity of a photosensor for detecting a minimum size of the original is heightened, and light emitting diodes of all photosensors are inhibited from being driven such that the photosensors can respond to only external light. In the second mode, when the platen cover is closed, since the external light that enters the photosensors becomes approximately zero, no detection signal is outputted from even the photosensor having higher total sensitivity, and therefore, it is possible to detect that the platen cover is closed.

13 Claims, 7 Drawing Sheets

IMAGE FORMING APPARATUS WITH PHOTOSENSORS FOR DETECTING ORIGINAL SIZE

This is a continuation of application Ser. No. 337,667, filed Apr. 13, 1989 now abandoned.

BACKGROUND OF THE INVENTION

1. Field of the Invention

The present invention relates to an image forming apparatus with photosensors for detecting an original size. More specifically, the present invention relates to an image forming apparatus such as an electrophotographic copying machine, facsimile or the like which includes a platen cover mounted to be opened or closed with respect to a platen on which an original is put and a plurality of reflection type photosensors are embedded in the platen cover.

2. Description of the Prior Art

One example of such kind of image forming apparatus is disclosed in, for example, Japanese Patent Application Laid-open No. 73623/1979 laid open on Jun. 13, 1979. In addition, one example of a copying machine in which reflection type photosensors are actually embedded in a platen cover is known as "XEROX 5030" (commodity name). As similar to a copying machine disclosed in Japanese Patent Application Laid-open No. 73623/1979, in this copying machine, reflection type photosensors are embedded in the platen cover and a size of an original put on the platen is automatically detected by the photosensors. In addition, in order to detect whether or not the platen cover is closed with respect to the platen, the product is provided with a detection switch which is turned on or off in response to opening or closing of the platen cover. The detection switch is actuated in response to that an actuator thereof is pressed by the platen when the platen cover is closed, whereby it is possible to detect that the platen cover is closed by the detection switch.

However, in the product having such a detection switch, there are disadvantages as set forth in the following. More specifically, when a thick original such as a book is put on the platen, since the platen cover can not be completely closed, the detection switch is not actuated, and therefore, erroneous detection that although the platen cover is closed by an operator, a copying process can not be started. In addition, since the above described detection switch is a mechanical switch which has an actuator, configuration of the platen cover to which such a mechanical switch is to be mounted becomes complex. Furthermore, since a special switch is needed, cost of the product becomes high.

SUMMARY OF THE INVENTION

Therefore, a principal object of the present invention is to provide a novel image forming apparatus.

Another object of the present invention is to provide an image forming apparatus in which it is possible to detect whether or not a platen cover is closed by reflection type photosensors which are embedded in the platen cover.

The other object of the present invention is to provide an image forming apparatus which does not use a special mechanical switch for detecting opening or closing of a platen cover.

An image forming apparatus in accordance with the present invention comprises a platen on which an original is put; a platen cover mounted to be opened or closed with respect to the platen; a plurality of photosensors embedded in the platen cover; and detecting means for detecting closing of the platen cover by means of at least one of the plurality of photosensors.

In a preferred embodiment, a sensor circuit including photosensors is set in a first mode or a second mode by a CPU. In the first mode, total sensitivity of each photosensor is set as the same as the others in the sensor circuit and a light emitting element of each photosensor is driven. Therefore, in the first mode, photosensors can detect a size of an original being put on the platen. In the second mode, the light emitting element of each photosensor is stopped to be driven and total sensitivity of a predetermined one is heightened. In the second mode, in the state where the original is put on the platen, but the platen cover is not closed, the predetermined photosensor outputs a detection signal in response to external light. At this time, since total sensitivity of each of remaining photosensors is maintained at relatively low, the remaining photosensors do not respond to the external light. Then, when the platen cover is closed, since the external light becomes approximately zero, no detection signal is outputted from even the predetermined photosensor. Thus, the CPU can detect whether or not the platen cover is closed with reference to the detection signal from the predetermined one of the plurality of photosensors.

In accordance with the present invention, since it is not necessary to provide a special and dedicated mechanical switch for detecting opening or closing the platen cover, an image forming apparatus which has a simple structure with less the number of parts and is cheap is obtainable.

The objects and other objects, features, aspects and advantages of the present invention will become more apparent from the following detailed description of the embodiments of the present invention when taken in conjunction with accompanying drawings.

DETAIL DESCRIPTION OF THE PREFERRED EMBODIMENTS

Figure 1:
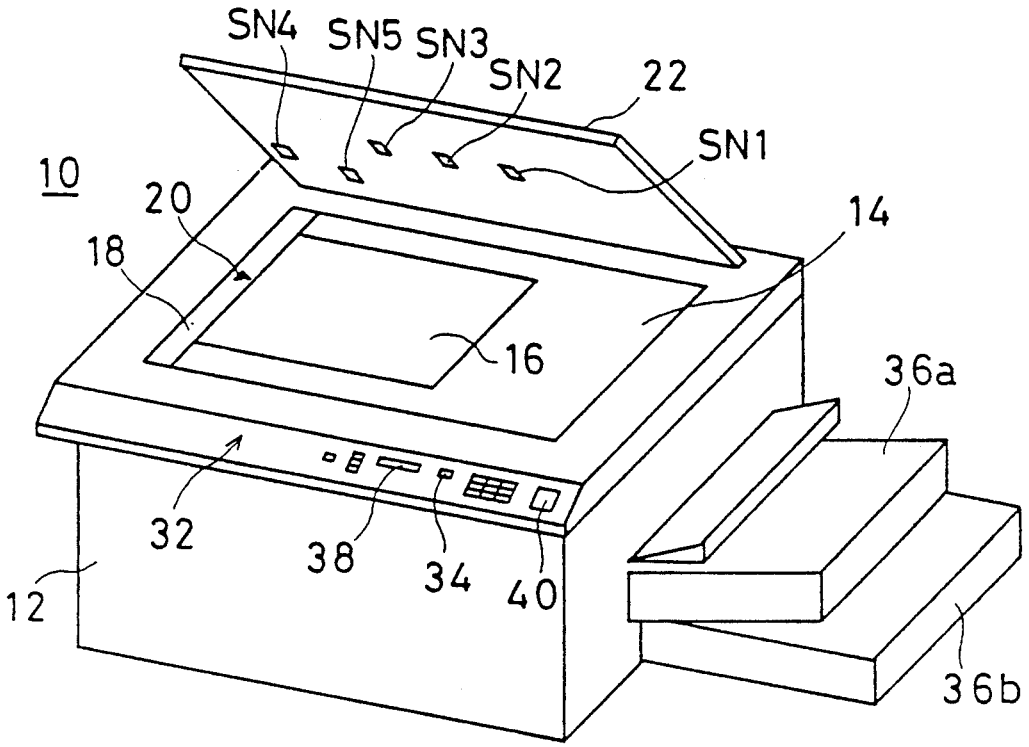
FIG. 1 is a perspective view showing one example of an electrophotographic copying machine as one embodiment in accordance with the present invention.

In FIG. 1, an electrophotographic copying machine as one embodiment in accordance with the present invention is shown. However, it is pointed out in advance that the present invention is applicable any image forming apparatus capable of an original size, for example, facsimile other than the electrophotographic copying machine.

With reference to FIG. 1, the electrophotographic copying machine 10 includes a body 12 on which an original table or platen 14 made of a transparent glass plate is fixedly provided. At the left end of the platen 14, a stopper 18 for positioning an original 16 is fixed. A center mark 20 is indicated at the center of the stopper 18. An operator is able to put the original 16 on the platen 14 such that the center of the original 16 can become coincident with the center mark 20. On an upper surface of the body 12, a platen cover 22 is fixed by hinges such that the platen cover 22 can be opened or closed with respect to the platen 14. A plurality of reflection type photosensors SN1, SN2, SN3, SN4 and SN5 for detecting a size of an original are embedded in the platen cover 22.

Figure 2A:
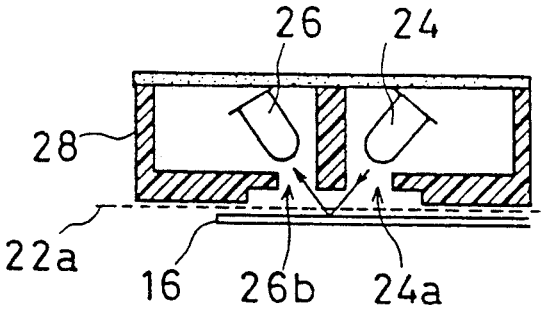
FIG. 2A and FIG. 2B are illustrative views showing a state where a reflection type photosensor is embedded in a platen cover and the reflection type photosensor, respectively.
Figure 2B:
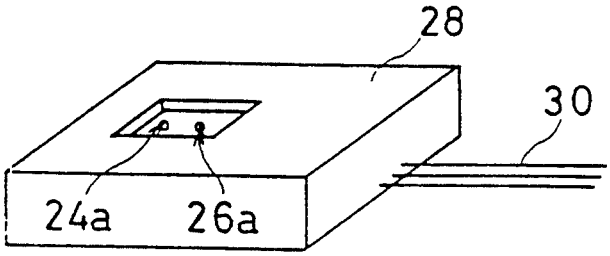

More specifically, as shown in FIG. 2A and FIG. 2B, each of the photosensors SN1-SN5 is constructed as a reflection type photosensor in which a light emitting diode 24 and a phototransistor 26 are arranged in the same plane. The light emitting diode 24 and the phototransistor 26 of the reflection type photosensor are accommodated in a sensor cover 28 on which openings 24*a* and 26*a* for emitting the light and for receiving the light are formed. The sensor cover 28, that is, the reflection type photosensor is embedded in the platen cover 22 and a surface of the platen cover 22 which contacts with the platen 14 is covered by a white semi-transparent film 22*a*. Therefore, the light from the light emitting diode 24 of the reflection type photosensor reaches the original 16 being put on the platen 14 through the semi-transparent film 22*a* and reflected by the same so as to be entered to the phototransistor 26. When the light is detected by the phototransistor 26, a detection signal is outputted from the phototransistor 26 through a lead wire 30.

Figure 3:
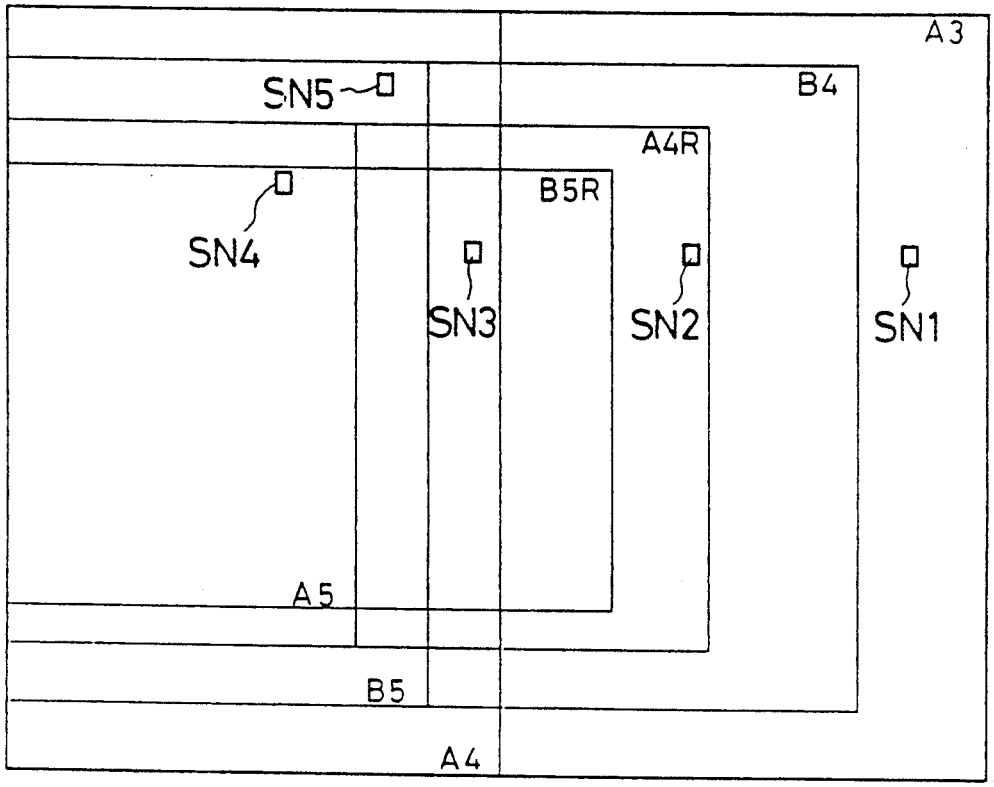
FIG. 3 is an illustrative view showing one example of arrangement of a plurality of reflection type photosensors.

The photosensors SN1-SN5 are arranged as shown in FIG. 3. More specifically, a size A5, B5, B5R, A4, A4R, B4 or A3 of an original put on the platen 14 can be detected by any one or more of the photosensors SN1-SN5. If detection signals are outputted from all of the photosensors SN1-SN5, the size A3 can be detected. In a similar manner, the size B4 can be detected by the photosensors SN2-SN5, the size A4R can be detected by the photosensors SN2-SN4, the size A4 can be detected by the photosensors SN3-SN5, the size B5R can be detected by the photosensors SN3 and SN4, the size B5 can be detected by the photosensors SN4 and SN5, and the size A5 can be detected by the photosensor SN4. However, such arrangement of the photosensors can be arbitrarily changed.

Returning to FIG. 1, on an upper surface of the body 12, an operation panel 32 is formed at this end, which includes an automatic paper feeding key 34. The automatic paper feeding key 34 is a key for selecting that a paper is to be automatically fed from a paper feeding cassette 36*a* or 36*b* which is loaded at a side surface of the body 12 in an attachable/detachable manner or that a paper is to be fed manually. When the automatic paper feeding key 34 is operated, a paper having the same size as the original size being detected by the photosensors SN1-SN5 is automatically fed or supplied from the paper feeding cassette 36*a* or 36*b*. The operation panel 32 further includes a selection key 38 for selecting the paper feeding cassette 36*a* or 36*b* and a start key 40 for commanding start of a copy process.

Figure 4:
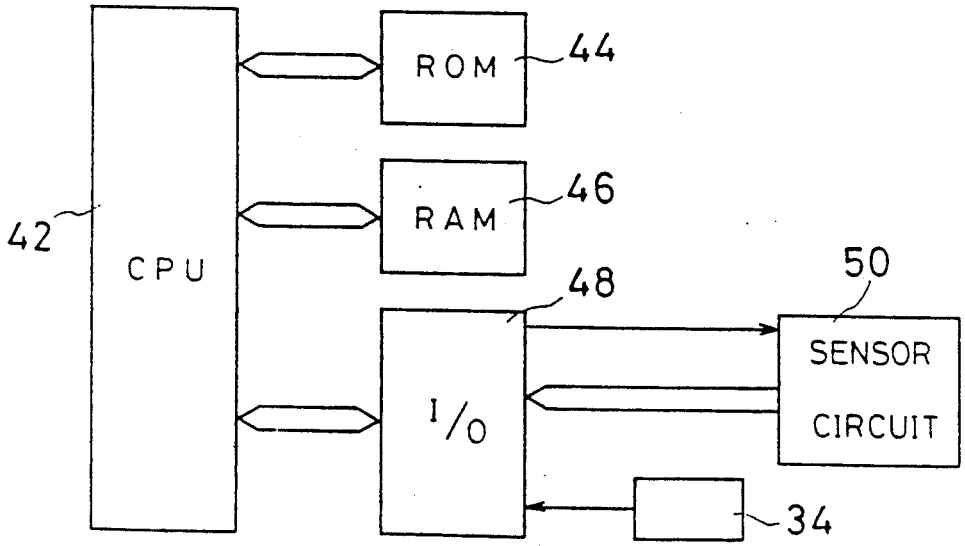
FIG. 4 is a block diagram showing an electrical construction of the embodiment.

With reference to FIG. 4, the copying machine of this embodiment is controlled by a microcomputer including a CPU 42. The microcomputer includes a ROM 44 which is connected to the CPU 42 and used for saving or storing a control program, etc., a RAM 46 which is connected to the CPU 42 and utilized for temporarily saving or storing data in controlling by the CPU and has a various kind of flag regions necessary for controlling, and an I/O interface 48. To an input port of the I/O interface 48, sensor inputs from a sensor circuit 50 which includes the above described photosensors SN1-SN5 and a key input from the automatic paper feeding key 34 are connected. An output port of the I/O interface 48, a mode signal outputted from the CPU 42 is outputted in order to selectively set a mode of the sensor circuit 50 in a first mode or a second mode. In addition, in the ROM 44, for each original size as shown in FIG. 3, data table representative of a series of data patterns of the sensor inputs from the photosensors SN1-SN5 is stored in advance, and when the sensor inputs are received by the CPU 42, the CPU 42 determines the original size with reference to the data table.

Figure 5:
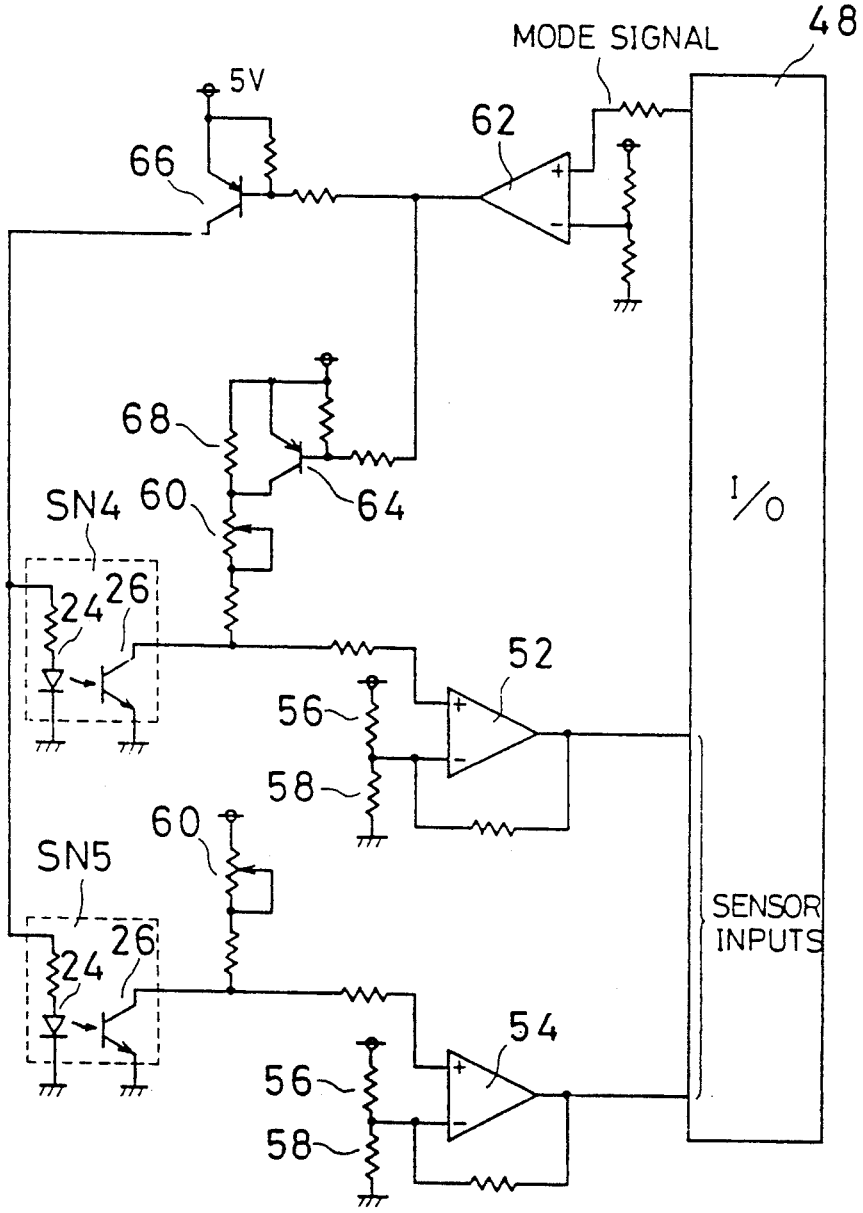
FIG. 5 is schematic diagram showing a sensor circuit associated with reflection type photosensors.

FIG. 5 shows the sensor circuit 50 in detail. In FIG. 5, since each of circuits associated with the photosensors SN1-SN3 is the same as a circuit of the photosensor SN5, such circuits are not illustrated. Therefore, detail description will be made on the photosensors SN4 and SN5 and the circuits associated therewith; however, it is to be understood that each of the photosensors SN1-SN3 is the same as the photosensor SN5.

Outputs from the phototransistors 26 (FIG. 2A) of the photosensors SN4 and SN5 are respectively connected to (+) terminals of comparators 52 and 54. A reference voltage (approximately 2.5V) which is decided by a resistors 56 and 58 is applied to respective one of (−) terminals of the comparators 52 and 54. Each of the comparators 52 and 54 outputs the high level "H" when an input voltage from the (+) terminal is higher than the reference voltage, and outputs the low level "L" when the input voltage is lower than the reference voltage. Outputs of the comparators 52 and 54 are inputted to the CPU 42 (FIG. 4) through the I/O interface 48 as the sensor inputs.

More specifically, when no light enters to the phototransistors 26 of the photosensors SN4 and SN5, each phototransistor 26 is in a cut-off state, and therefore, the input voltage to each of the comparators 52 and 54 becomes approximately 5V. Therefore, the sensor input becomes "H". When the light enters to the phototransistor 26, the phototransistor 26 conducts with a conduction degree in accordance with strength of the light being entered. Therefore, when the light having predetermined strength or more is entered to the phototransistor 26, each of the input voltage of the comparators 52 and 54 becomes lower than the reference voltage, so that the sensor inputs of "L" are applied to the I/O interface 48.

In addition, variable resistors 60 are respectively connected to outputs of the phototransistors 26 included in the photosensors SN4 and SN5. Each of the variable resistors 60 can be utilized for adjusting total sensitivity of the photosensors SN4 and SN5. More specifically, when a resistance value of the variable resistor 60 is large, a voltage which is divided by the phototransistor 26 and variable resistor 60 becomes small. Therefore, even if the strength of the light being entered to the phototransistor 26 is small, a detection signal of "L" is obtained from each of the comparators 52 and 54. Thus, when the resistance value of the variable resistor 60 is made large, the total sensitivity of each of the photosensors SN4 and SN5 becomes large. Inversely, when the resistance value of the variable resistor 60 is made small, the voltage which is applied to the phototransistor 26 becomes large, the total sensitivity of each of the photosensors SN4 and SN5 becomes small.

When the mode signal which is outputted from the CPU 42 through the I/O interface 48 is "L", the sensor circuit 50 is set in the first mode. The first mode is a mode for detecting the original size by the photosensors SN1–SN5. In the first mode, an output of a comparator 62 becomes "L", and thus, a transistor 64 is turned on. In this state, the total sensitivity of each of the photosensors SN4 and SN5 is primarily decided by the variable resistor 60, and therefore, the total sensitivity of each of the photosensors SN1–SN5 is set as the same. In addition, when the mode signal is "L", that is, when the first mode is set, since a transistor 66 is turned on by an output of "L" from the comparator 62, a voltage is applied to the light emitting diode 24 of each of photosensors SN4 and SN5. Therefore, each of the photosensors SN1–SN5 can respond to the reflection light of the light from the light emitting diode 24 of itself. Therefore, it is possible to detect the size of the original 16 (FIG. 1) put on the platen 14 by the sensor inputs from the photosensors SN1–SN5.

On the other hand, when the mode signal from the CPU 42 is "H", the sensor circuit 50 is set in the second mode. The second mode is a mode for detecting opening or closing of the platen cover 22 (FIG. 1) by the photosensor SN4. In the second mode, the output of the comparator 62 becomes "H" and the transistor 66 is turned off, and therefore, the light emitting diode 24 of each of the photosensors SN4 and SN5 can not be driven. At this time, since the transistor 64 is also turned off, a resistor 68 is connected to the variable resistor 60 of the photosensor SN4 in series, and therefore, the total sensitivity of the photosensor SN4 becomes large. At this time, since no light emitting diode is driven, the light which is entered to the phototransistor 26 is external light rather than the reflection light from the original. Since the external light is normally weaker than the reflection light from the original, only the photosensor SN4 the total sensitivity of which is made larger can detect the external light. Therefore, when the detection signal of "L" is obtained from the photosensor SN4 and thus the comparator 52 in the second mode, the platen cover 22 (FIG. 1) is opened. If the platen cover 22 is completely closed, the external light becomes approximately zero, and therefore, the sensor input from the photosensor SN4 and thus the comparator 52 becomes "H". Thus, when the sensor circuit 50 is set in the second mode, it is possible to detect the closing of the platen cover 22 by means of the photosensor SN4 which detects a minimum size A5 of the original.

Figure 6:
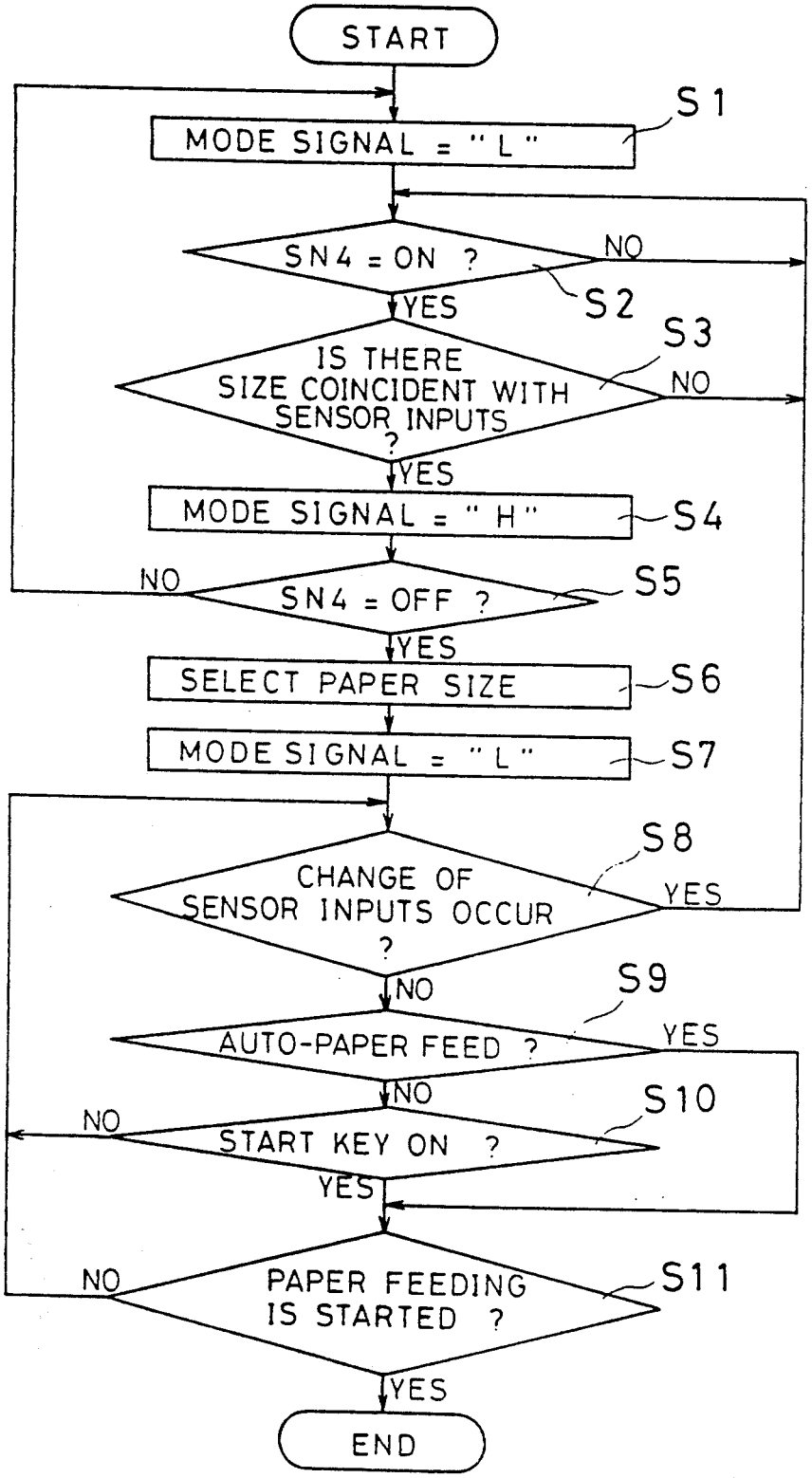
FIG. 6 is a flow chart showing an operation of the embodiment.

With reference to FIG. 6, in the first step S1, the CPU 42 (FIG. 4) makes the mode signal "L", whereby the sensor circuit 50 as shown in FIG. 5 is set in the first mode.

In the succeeding step S2, it is determined whether or not the photosensor SN4 is turned on, that is, whether or not the sensor input from the comparator 52 becomes "L". As described above, since the SN4 is positioned at a position capable of detecting a minimum size of the original, if the original is put on the platen 14 and platen cover 22 is closed, the photosensor SN4 is necessarily turned on, and therefore, it is possible to detect that the original 16 is put on the platen 14 by means of the detection signal from the photosensor SN4.

When "YES" is determined in the step S2, in the step S3, with reference to the data table of the ROM 44, it is determined whether or not the data pattern of the sensor inputs from the photosensors SN1–SN5 is representative of the original size, that is, whether or not the data pattern of the sensor inputs at this time is coincident with any one of data patterns stored in the ROM 44. When "NO" is determined in this step S3, since the original is not correctly set or the platen cover 22 is not completely closed, the process returns the step S2 again.

Then, when "YES" is determined in the step S3, that is, when the original size is detected, in the step S4, the CPU 42 makes the mode signal "H". In this state, as described above, the sensor circuit 50 becomes the second mode from the first mode. Therefore, in the succeeding step S5, the CPU 42 determines whether or not the sensor input from the photosensor SN4 as shown in FIG. 5 is "H", that is, whether or not the photosensor SN4 is turned off. If the platen cover 22 (FIG. 1) is completely closed, as described above, the detection signal from the photosensor SN4 becomes "H". However, if the platen cover 22 is not closed, the photosensor SN4 is remained in an ON state and therefore the process returns the step S1 again. If "YES" is determined in the step S5, the process proceeds to the next step S6. Thus, by confirming an OFF state of the photosensor SN4 in the step S5, even when the photosensors SN1–SN5 are erroneously operated due to relative strong external light in the steps S2 and S3, erroneous determination of paper size is avoidable.

In the step S6, the paper feeding cassette **36*a* or 36*b* (FIG. 1) which stores a paper having the same size as the original size being detected in the step S3 is selected. At this time, if no paper having the same size, this is indicated on a display portion (not shown) of the operation panel 32 (FIG. 1**).

In the next step S7, the CPU 42 changes the mode signal into "L" again so as to set the sensor circuit 50 in the first mode. In the step S8, it is determined whether or not any change occurs in the sensor inputs from the photosensors SN1–SN5. If change occurs, the process returns the step S2 so as to repeat the steps S2–S7. This becomes a trigger for detecting that the platen cover 22 is opened. More specifically, in the above described steps S2–S7, after detection that the original having a given size is put on the platen 14 and the platen cover 22 is closed, if the platen cover 22 has been opened, it is impossible to start a copying process. Therefore, when the change occurs in the sensor inputs from the sensor circuit 50 in the step S8, the steps S2–S7 is repeated so as to detect the paper size again. In addition, if the original size is erroneously detected due to influence that the sensor inputs become unstable in closing the platen cover 22, by repeating the steps S2–S7, it is possible to determine a correct original size.

If it is determined that no change occurs in the sensor inputs in the step S8, in the step S9, the CPU 42 determines whether or not the automatic paper feeding key 34 is operated, that is, whether or not the automatic paper feeding mode is set. When the automatic paper feeding mode is set, without through the step S10, a copying process is started. In the step S11, in order to start the copying process, the CPU 42 determines whether or not paper feeding is started. If "NO" is determined in the step S11, the process returns the step S7 such that any change in the sensor inputs can be detected again. If "YES" is determined in the step S11, detection of the original size is terminated. In addition, in the case where the automatic paper feeding mode is not set, in the step S10, it is determined whether or not the start key 40 is operated. If the start key is operated, the process proceeds to the step S11, but if the start key 40 is not operated, the process returns the step S8 so as to determine again whether or not any change occurs in the sensor input.

Thus, even if the operator operates the operation panel 32 to start the copying process, if the platen cover 22 is closed until the paper feeding is started, the paper having the same size as the original size can be automatically selected.

Figure 7:
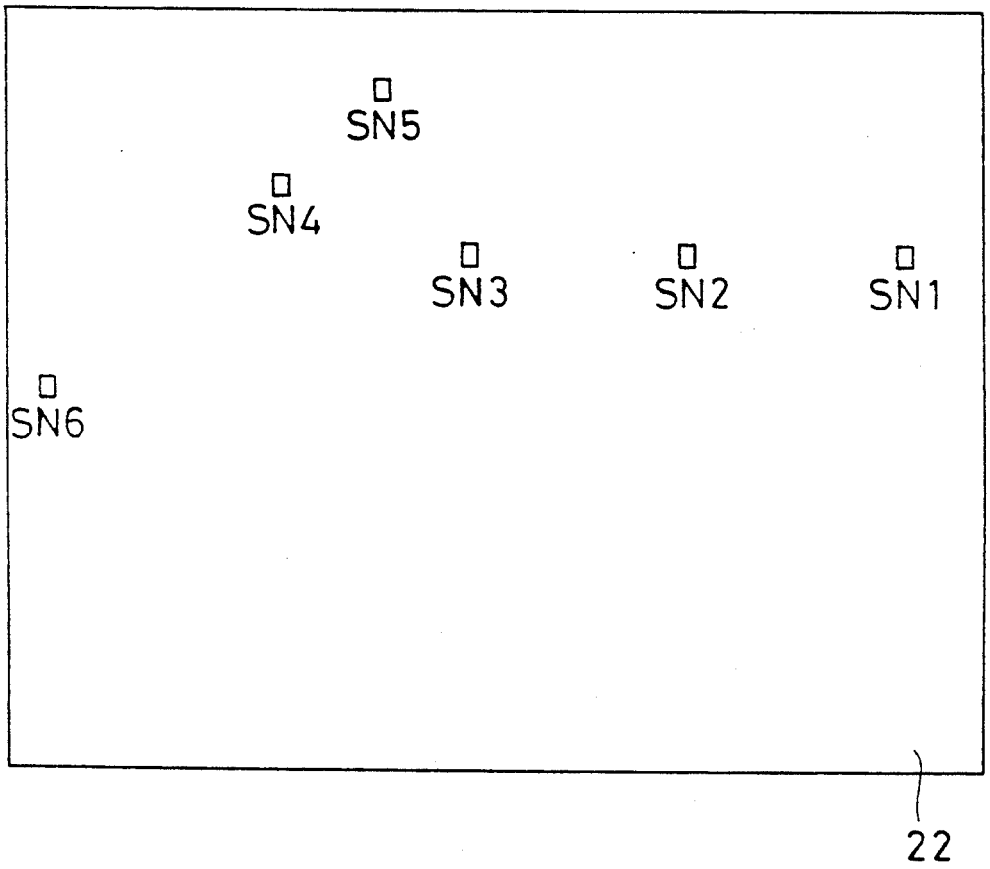
FIG. 7 is an illustrative view showing another example of arrangement of a plurality of reflection type photosensors.

In FIG. 7 embodiment, a reflection type photosensor SN6 is embedded in the platen cover 22 in addition to the above described photosensors SN1-SN5. The photosensor SN6 is positioned in the vicinity of the center mark 20 of the stopper 18 (FIG. 1), and therefore, it is possible to necessarily detect an original even if an original having any size is put on the platen 14. This means that the photosensor SN6 functions as an original sensor.

Figure 8:
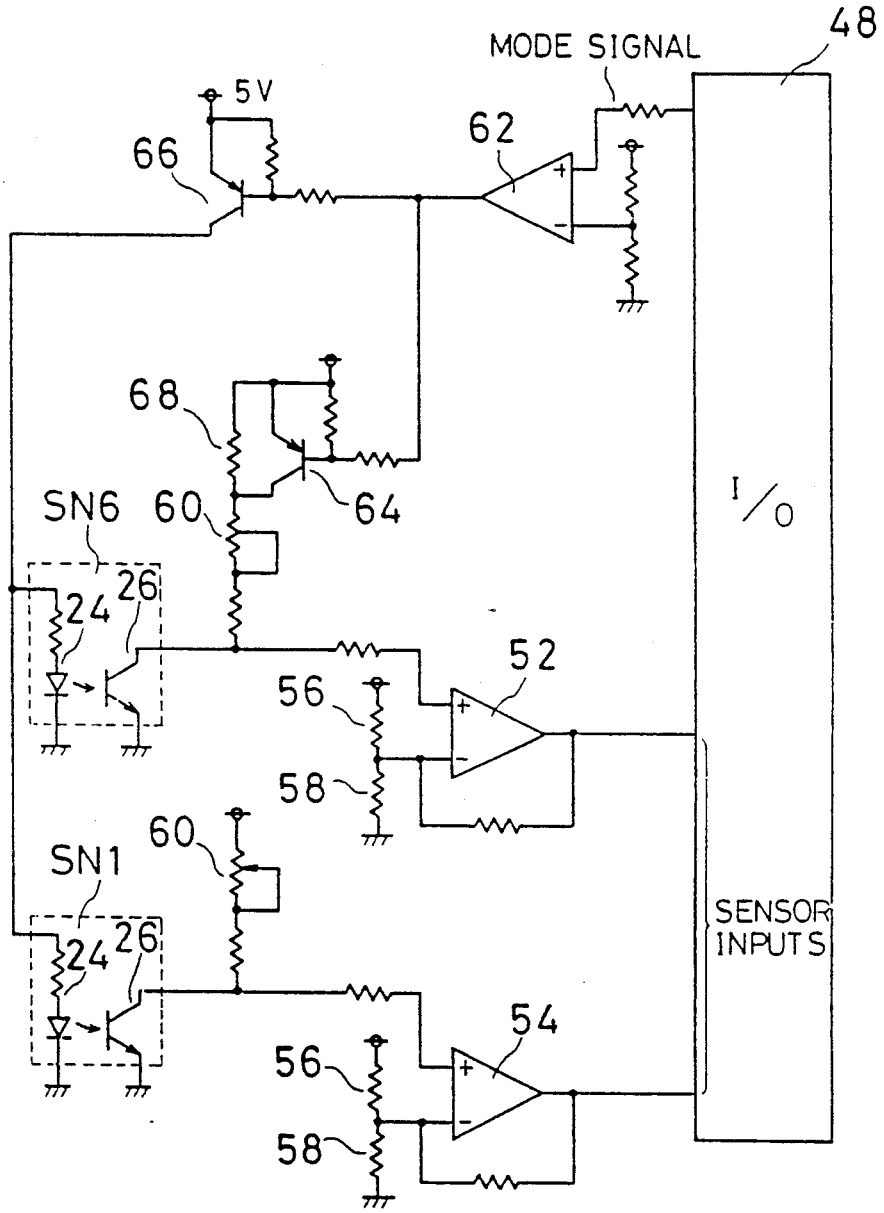
FIG. 8 is a schematic diagram showing a sensor circuit in FIG. 7 embodiment.

In FIG. 7 embodiment, in order to use the original sensor SN6 as opening/closing sensor of the platen cover 22, as shown in FIG. 8, likewise the photosensor SN4 of FIG. 5, a transistor 64 and a resistor 68 are connected to the photosensor SN6. Each of the remaining photosensors SN1-SN5 of this embodiment has the same construction as each of the photosensors SN1-SN3 and SN5 of FIG. 5 embodiment.

Figure 9:
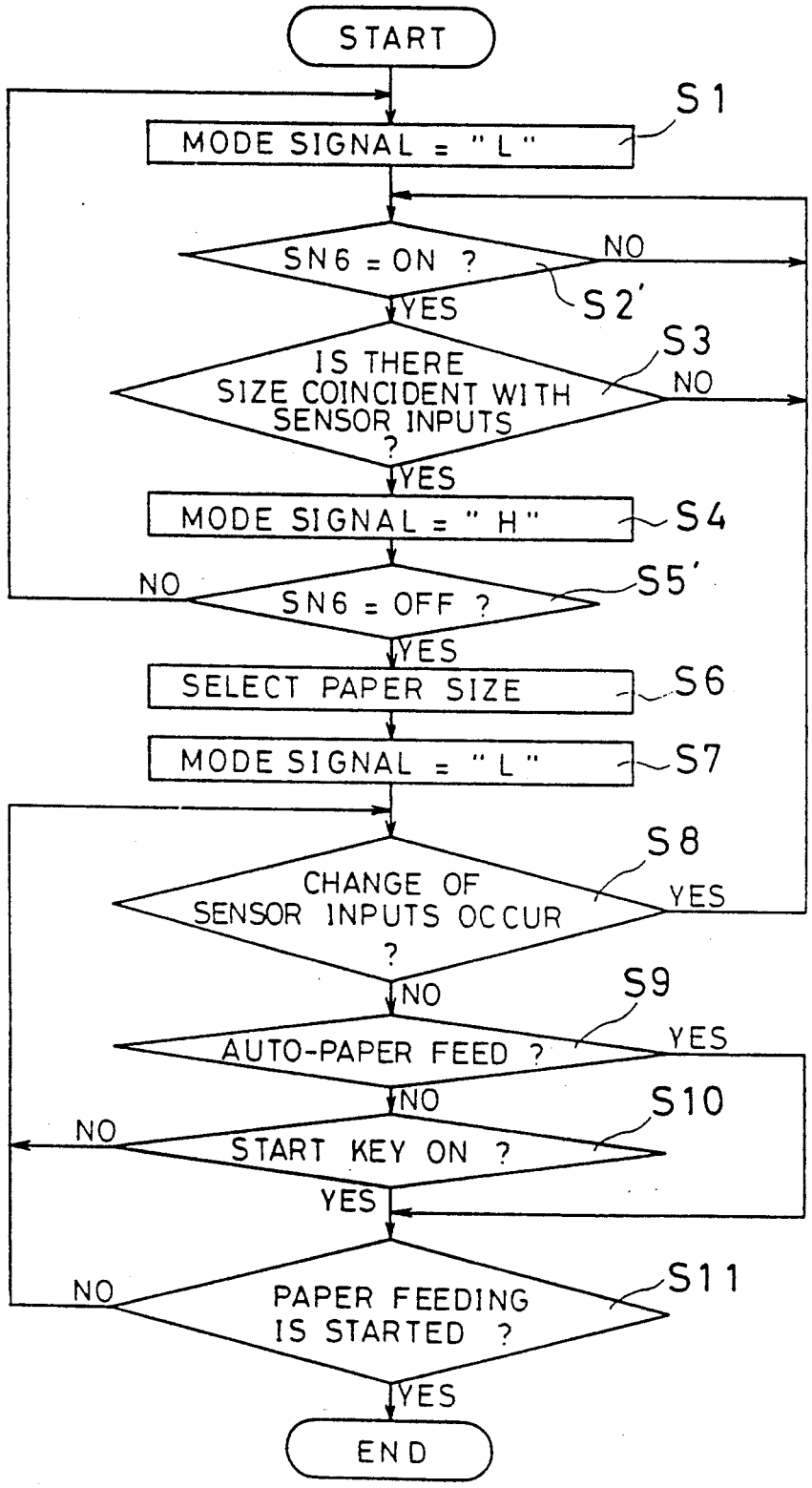
FIG. 9 is a flow chart showing an operation of FIG. 7 embodiment.

In addition, the embodiment shown in FIG. 7 and FIG. 8, an operation is executed in accordance with a flow chart shown in FIG. 9. FIG. 9 flowchart is different from FIG. 6 flowchart in the point that ON or OFF of the photosensor SN6 is determined in the steps S2' and S5'. More specifically, in FIG. 6 embodiment, in order to determine whether or not the platen cover 22 is closed, the photosensor SN4 is utilized. By contrast, in this embodiment shown, the photosensor SN6 is utilized for detecting opening or closing of the platen cover 22.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a platen on which an original is put;

a platen cover mounted such that said platen cover can be opened or closed with respect to said platen;

a plurality of reflection type photosensors embedded in said platen cover;

a first detection means for detecting a size of an original being put on said platen by means of said plurality of photosensors;

a second detection means for detecting closing of said platen cover by means of a predetermined one of said plurality of photosensors, said plurality of photosensors being included in a sensor circuit; and a mode setting means for selectively setting a mode of said sensor circuit in a first mode where said first detection means becomes operable or a second mode where said second detection means becomes operable, responsive characteristics of said plurality of photosensors being changed in said first mode or second mode.

2. An image forming apparatus in accordance with claim 1, wherein said plurality of photosensors are positioned such that the same can detect different sizes of an original from a minimum size to a maximum size.

3. An image forming apparatus in accordance with claim 2, wherein said predetermined one for said second detection means is a photosensor which is utilized for detecting said minimum size.

4. An image forming apparatus in accordance with claim 2, wherein said plurality of photosensors include an original sensor which is operated when the original is put on said platen and detects that an original is put on said platen, said predetermined one for said second detection means is said original sensor.

5. An image forming apparatus in accordance with claim 1, wherein each of said plurality of photosensors includes a light emitting element and a light receiving element arranged such that said light receiving element can respond the light from said light emitting element as reflected, further comprising a control means for enabling said light emitting element of each of said plurality of photosensors when said first mode is set and for disabling said light emitting element of each of said plurality of photosensors when said second mode is set.

6. An image forming apparatus in accordance with claim 5, further comprising a sensitivity control means for controlling total sensitivity of said predetermined one of said plurality of photosensors higher than that of the other ones when said second mode is set.

7. An image forming apparatus in accordance with claim 1, further comprising a third detection means for finally determining the size of the original by confirming said plurality of photosensors until an image forming process is started after said second detection means has detected that said platen cover is closed.

8. An image forming apparatus in accordance with claim 7, further comprising a paper feeding means for feeding a paper having a size equal to the size of the original after the size of the original is finally determined by said third detection means.

9. A method for controlling an image forming apparatus which comprises a platen on which an original is put, a platen cover mounted such that said platen cover can be opened or closed with respect to said platen, and a plurality of reflection type photosensors embedded in said platen cover for detecting original sizes from a minimum size to a maximum size, including following steps of:

(a) detecting closing of said platen cover by sensing a signal from one of said plurality of photosensors for detecting said minimum size of the original sizes;

(b) detecting a size of an original being put on said platen on the basis of a pattern of signals from said plurality of photosensors;

(c) detecting again the closing of said platen cover by means of said one of said plurality of photosensors for detecting said minimum size of the original sizes; and (d) continuously detecting whether or not change occurs in said pattern of said signals from said plurality of photosensors until an image forming process is started.

10. An image forming apparatus, comprising:

a platen on which an original is put;

a platen cover mounted such that said platen cover can be opened or closed with respect to said platen;

a plurality of reflection type photosensors embedded in said platen cover for detecting original sizes from a minimum size to a maximum size;

first means for detecting closing of said platen cover by sensing a signal from one of said plurality of photosensors for detecting said minimum size of the original sizes;

second means for detecting a size of an original being put on said platen on the basis of a pattern of signals from said plurality of photosensors;

third means for detecting again the closing of said platen cover by means of said one or said plurality of photosensors for detecting said minimum size of the original sizes; and fourth means for continuously detecting whether or not change occurs in said pattern of said signals from said plurality of photosensors until an image forming process is started.

11. An image forming apparatus in accordance with claim 10, further comprising paper feeding means for feeding a paper having a size equal to the size of the original only when said fourth means detects no change.

12. An image forming apparatus, comprising:

a platen on which an original is put;

a platen cover mounted such that said platen cover can be opened or closed with respect to said platen;

first detecting means for detecting closing of said platen cover;

second detecting means for detecting a size of an original being put on said platen;

means for causing said second detecting means to effect continuous detection of the size of the original until an image forming process is started; and means for determining a correct original size even when said second detecting means provides an initial erroneous detection due to an influence caused by closing of the platen cover on said second detecting means, said determining means basing determination of the correct original size on a repetition of the detecting by said means for causing said second detecting means to effect continuous detection.

13. An image forming apparatus, comprising:

a platen on which an original is put;

a platen cover mounted such that said platen cover can be opened or closed with respect to said platen;

first platen cover detecting means for detecting closing of said platen cover;

first original size detecting means for detecting a size of an original being put on said platen;

second plate cover detecting means for detecting again the closing of said platen cover;

second original size detecting means for continuously detecting the original size until an image forming process is started; and means for determining a correct original size even when said first original size detecting means provides an initial erroneous detection due to an influence caused by closing of the platen cover on said original size detecting means, said determining means basing determination of the correct original size on a repetition of the detecting by said second original size detecting means.

* * * * *